US010226113B2

(12) United States Patent
Lucido

(10) Patent No.: US 10,226,113 B2
(45) Date of Patent: Mar. 12, 2019

(54) MECHANICAL HAIR PULLER

(71) Applicant: Michael Victor Lucido, Mountain Home, AR (US)

(72) Inventor: Michael Victor Lucido, Mountain Home, AR (US)

( * ) Notice: Subject to any disclaimer, the term of this patent is extended or adjusted under 35 U.S.C. 154(b) by 810 days.

(21) Appl. No.: 14/166,469

(22) Filed: Jan. 28, 2014

(65) Prior Publication Data

US 2014/0222027 A1 Aug. 7, 2014

Related U.S. Application Data

(60) Provisional application No. 61/761,656, filed on Feb. 6, 2013.

(51) Int. Cl.
*A45D 26/00* (2006.01)

(52) U.S. Cl.
CPC ..... *A45D 26/0047* (2013.01)

(58) Field of Classification Search
CPC ..... A45D 26/0052; A45D 26/0047; A45D 26/00; A45D 26/0071; A61B 17/32053; A61B 17/32093; A61B 2017/00969; A61B 2017/320064; A61B 2017/00544; A61B 2010/0208; A61B 2090/034; A61B 17/50
USPC ..... 606/133
See application file for complete search history.

(56) References Cited

U.S. PATENT DOCUMENTS 1,036,725 A * 8/1912 Sabo ..... 606/133
2,458,911 A * 1/1949 Kerr ..... A45D 26/0047 606/133
5,817,120 A * 10/1998 Rassman ..... A61B 17/3468 606/185
2010/0030234 A1* 2/2010 Bodduluri ..... A61B 17/32053 606/130

* cited by examiner

*Primary Examiner* — Diane D Yabut
*Assistant Examiner* — Socrates L Boutsikaris
(74) *Attorney, Agent, or Firm* — Chen-Chi Lin

(57) ABSTRACT

This invention relates to the removal of hair including the root, from the nostrils and the ear canals, as well as for some various facial hairs. It is a mechanical device using a tension coil spring attached to a plunger and housing assembly to extend the spring, thereby creating multiple openings between the individual coils of the spring so as to allow multiple hairs to enter the openings, after which the plunger is released and the coils of the spring retract, grabbing the hairs with adequate friction to pull them out. This device is operated by the thumb and two fingers and can remove any unwanted hair, particularly nose and ear hair, within a couple of minutes with almost no pain.

5 Claims, 1 Drawing Sheet

MECHANICAL HAIR PULLER

FIELD OF THE INVENTION

This invention relates generally to removal of hairs. More particularly, the present invention relates to a mechanical hair puller and a method of hair removal.

BACKGROUND OF THE INVENTION

A tweezer, a rotary nose hair clipper or trimmer, a waxing method, a razor, and a pair of scissors have been used to remove hairs. Those devices and methods are usually associated with higher cost, longer processing time, and more pain.

SUMMARY OF THE INVENTION

A mechanical hair puller of the present disclosure has a plunger, a housing, and a spring. The mechanical hair puller is operated by a thumb and two fingers of a user. The mechanical hair puller can remove unwanted hairs, particularly nose and ear hairs, within a couple of minutes with almost no pain.

DETAILED DESCRIPTION OF THE INVENTION

Figure 1:
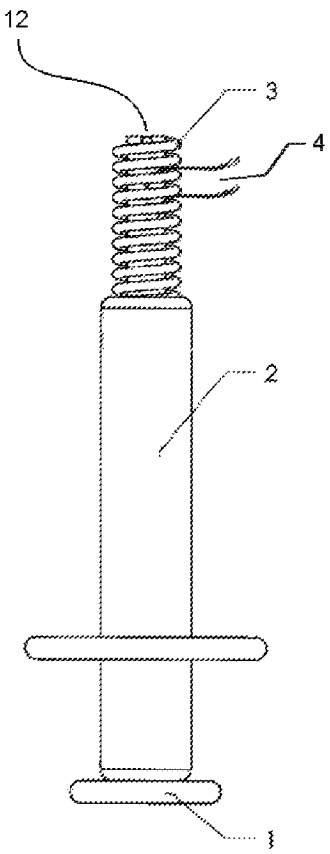
FIG. 1 shows a mechanical hair puller in examples of the present disclosure.

FIG. 1 shows a mechanical hair puller with a spring 3 extended by a plunger 1 being pushed into an elongate substantially cylindrical housing 2 to make the spring 3 ready to grab hairs 4. The spring 3 has a spring tab 12. The plunger 1 pushes the spring tab 12 to extend the spring 3.

Figure 4:
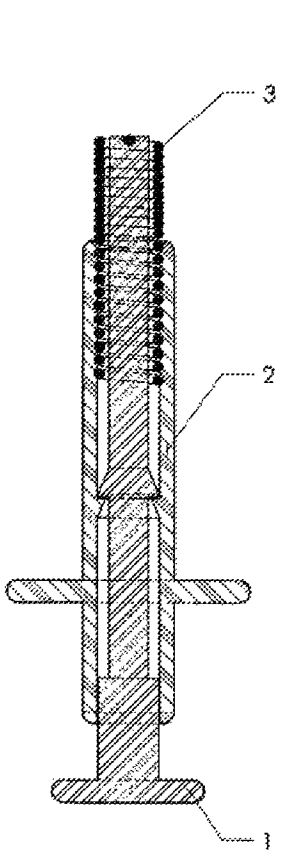
FIG. 4 shows a cross sectional view of the mechanical hair puller of FIG. 3.
Figure 2:
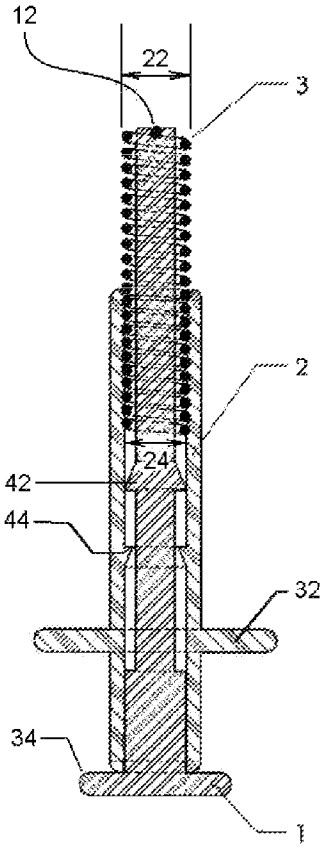
FIG. 2 shows a cross sectional view of the mechanical hair puller of FIG. 1.

FIG. 2 shows a cross section cutaway showing the relationship of the three components, 1 is the plunger, 2 is the housing and 3 is the extension spring in the extended position, ready to grab the hairs. In examples of the present disclosure, the plunger 1 has a thumb rest 34 and a plunger stop 42. In examples of the present disclosure, the housing 2 has a finger rest 32 and a stopper 44. In examples of the present disclosure, the spring 3 has a spring tab 12. In examples of the present disclosure, the outer diameter 22 of the undeformed spring 3 is larger than the inner diameter 24 of the housing 2. A portion of the plunger 1 slides within the housing 2 over a limited range of movement between a first end position and a second end position. The plunger stop 42 of the plunger 1 contacts the stopper 44 of the housing 2 at the first end position (FIG. 4). The thumb rest 34 of the plunger 1 contacts a bottom surface of the housing 2 at the second end position (FIG. 2).

Figure 3:
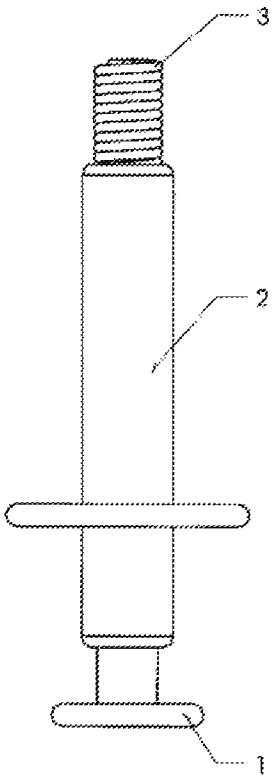
FIG. 3 shows the mechanical hair puller of FIG. 1 in a neutral or a retracted position.

FIG. 3 shows the device in the neutral or retracted position with the hairs 4, attached after removal.

FIG. 4 shows a cross section of the device in the neutral position with the hairs, attached after removal. To remove the hairs from the device, simply push the plunger 1 in and blow on the hairs and you are ready for another step using the same procedure, generally removing multiple hairs simultaneously each time.

The spring 3 is attached to the housing 2 by screwing it into the housing 2 which provides larger or smaller hair grabbing openings by screwing the spring further in or out.

PRIOR ART

Ever since the dawn of mankind, nose and ear hair have been an issue to either live with, or to somehow deal with some of its inherent discomfort. There have been various methods and instruments developed for the specific purpose of removing such hair. One is the tweezers, which usually tends to be arduously time consuming and very painful, since only one or two hairs can be pulled out, at a time. Another instrument is the rotary nose hair clippers or trimmer which only cuts the hair, leaving the root. The hair then re-grows within a couple of weeks requiring an almost weekly repeated process. A third method is by waxing, which requires hard wax to be melted and then applied on the end of a stick to the inside of the nostril or ear canal and allowed to cool. When sufficiently cooled, the wax adheres to most of the hairs at the same time, and then is quickly pulled out; while quite a few hairs are removed simultaneously by their roots this way it is not easily done by oneself, for it is just a bit too painful. The waxing process is usually provided by a beautician for a charge of $15 to over $35, thus creating discomfort within the pocket book, as well. Razors and or scissors have been used to a great extent, but have the inherent hazard of nicks and cuts. Self-grooming however, with the Mechanical Hair Puller incurs very little pain at almost no cost and removal of the hair with the root intact makes it much more easily completed, more efficiently and one of more or less a monthly procedure rather than a weekly process by the cutting/trimming method.

The invention claimed is:

1. A mechanical hair puller for pulling unwanted hairs, the mechanical hair puller comprising:

an elongate substantially cylindrical housing having a finger rest and a stopper;

a plunger having a thumb rest and a plunger stop; and a spring having a spring tab at a top end of the spring;

wherein an outer diameter of the spring at an undeformed state is larger than an inner diameter of the housing;

wherein a bottom portion of the spring is screwed into a top portion of the housing;

wherein a portion of the plunger slides within the housing over a limited range of movement between a first end position and a second end position;

wherein the plunger stop of the plunger contacts the stopper of the housing at the first end position;

wherein the thumb rest of the plunger contacts a bottom surface of the housing at the second end position; and wherein a top surface of the plunger pushes the spring tab and extends a top portion of the spring during a movement of the plunger toward the second end position.

2. The mechanical hair puller of claim 1, wherein the thumb rest of the plunger is configured to receive a thumb of a user and the finger rest of the housing is configured to receive an index finger and a middle finger of the user.

3. The mechanical hair puller of claim 1, wherein the extended top portion of the spring is configured to capture the unwanted hairs.

4. A method for a user to utilize the mechanical hair puller of claim 1 to pull the unwanted hairs, the method comprising:

holding the mechanical hair puller by a thumb, an index finger, and a middle finger of the user, wherein the thumb presses on a bottom surface of the thumb rest of the plunger and the index finger and the middle finger press on a top surface of the finger rest of the housing;

increasing pressure from the thumb so as to push the plunger toward the second end position and to extend the top portion of the spring;

capturing the unwanted hairs by the extended top portion of the spring;

decreasing pressure from the thumb so that the plunger moves toward the first end position, the top portion of the spring returns to the undeformed state, and the undeformed top portion of the spring securely holds the unwanted hairs; and pulling the unwanted hairs out of skins of the user.

5. The method of claim 4, wherein the unwanted hairs are nose hairs or ear hairs of the user.

* * * * *